US005914850A

United States Patent [19]

Johansson

[11] Patent Number: 5,914,850

[45] Date of Patent: Jun. 22, 1999

[54] CONTACTOR EQUIPMENT

[75] Inventor: Gunnar Johansson, Västerås, Sweden

[73] Assignee: Asea Brown Boveri AB, Vasteras, Sweden

[21] Appl. No.: 08/790,304

[22] Filed: Jan. 31, 1997

[30] Foreign Application Priority Data

Feb. 7, 1996 [SE] Sweden ..... 9600444

[51] Int. Cl.[6] ..... H01H 47/04

[52] U.S. Cl. ..... 361/187; 361/154

[58] Field of Search ..... 361/152–156, 361/187, 160

[56] References Cited

U.S. PATENT DOCUMENTS

| | | | |
|---|---|---|---|
| 3,864,608 | 2/1975 | Normile et al. | 361/154 |
| 4,169,401 | 10/1979 | Walker | 361/154 |
| 4,347,544 | 8/1982 | Ohba | 361/154 |
| 4,377,144 | 3/1983 | Takahashi | 361/154 |
| 4,516,185 | 5/1985 | Culligan et al. | 361/154 |
| 4,605,983 | 8/1986 | Harvey | 361/154 |
| 4,630,165 | 12/1986 | D'Onofrio | 361/154 |
| 4,729,056 | 3/1988 | Edwards et al. | 361/154 |
| 4,764,840 | 8/1988 | Petrie et al. | 361/154 |
| 4,770,178 | 9/1988 | Sausner et al. | 361/154 |
| 4,878,147 | 10/1989 | Oyama et al. | 361/154 |
| 4,947,283 | 8/1990 | Kono | 361/154 |
| 5,113,307 | 5/1992 | Meyer et al. | 361/154 |
| 5,471,360 | 11/1995 | Ishikawa et al. | 361/154 |

FOREIGN PATENT DOCUMENTS

| | | |
|---|---|---|
| 2 601 191 | 1/1988 | France . |
| 2 617 634 | 1/1989 | France . |
| WO 86/01332 | 2/1986 | WIPO . |

*Primary Examiner*—Fritz Fleming
*Attorney, Agent, or Firm*—Pollock, Vande Sande & Amernick

[57] ABSTRACT

Contactor equipment with an operating magnet with an operating coil (CW) as well as an armature, which moves in dependence on the current through the operating coil. The contactor has control means (TR, CC, R1. R2, R3) which control the voltage supplied to the operating coil. During the closing operation of the contactor, for utilization of the current-reducing effect of the change of inductance taking place because of the movement of the armature during a closing operation, a voltage is supplied to the operating coil which is substantially constant during the closing operation and independent of the current of the operating coil. After a completed closing operation, the current is controlled through the operating coil in accordance with a reference value.

14 Claims, 2 Drawing Sheets

CONTACTOR EQUIPMENT

TECHNICAL FIELD

The invention relates to contactor equipment with an electromagnetic contactor, comprising an operating magnet with an operating coil for connection to a supply voltage source, an armature moving in dependence on the current through the operating coil, a number of contacts which are influenced by the armature, control means adapted to sense the current through the operating coil and, for control of the current of the operating coil, to control the voltage applied to the operating coil in dependence on the sensed current.

BACKGROUND ART

Electromagnetic contactors are known and have been used for a long time, for example, as a switching means between a voltage source and an electric motor.

From, for example, patent publications FR-B1-2 601 191, FR-B1-2 617 634 and WO-A1-86/01332 it is known to arrange a control means, preferably a switching transistor, in series with the operating coil of the contactor and to control, with the aid of the control means, the mean value of the voltage applied to the operating coil such that the'current of the coil is maintained at a desired value. In this way, the function of the contactor may become, to a certain extent, independent of the supply voltage, the supply voltage can then vary between the limits $U_{min}$-$U_{max}$, e.g., 80–275 V, where $U_{min}$ is the minimum required voltage for closing the contactor. Further, by using a higher reference value for the current during the closing operation of the contactor and a lower reference value in the closed condition, a rapid closing operation may be obtained simultaneously with low power consumption in the closed condition.

In a contactor, the inductance of the operating coil is changed during the closing operation because of the movement of the armature. This change of inductance causes an electromotive force (emf)to form in the operating coil. This emf is proportional to the time rate of change of the inductance and is directed opposite to the voltage applied to the coil. In this way, in contactors without control of the coil current, when the armature has reached a high speed, a considerable reduction of the resultant voltage is obtained and hence there is a reduction in the current of the coil and in the acceleration of the armature during the latter part of the closing operation.

In a contactor with control of the coil current, however, the control system will sense the current which decreases during the closing operation and will attempt to counteract this by increasing the voltage applied to the coil. This results in the coil current and hence the acceleration of the armature, generally becoming considerably higher during the latter part of the closing operation than is the case in a corresponding contactor without current control. This, in turn, results in a high speed of the armature at the end of the closing operation. It has been found that this "hard" closing operation entails significant drawbacks. Increased wear occurs on the pole surfaces, which results in an increased risk of functional disorders, for example by a so-called remanence air gap decreasing or disappearing and causing adherence of the armature. Further, the risk of functional disorders increases in that there are high mechanical stresses on all the moving parts of the contactor. An additional disadvantage is the increasing tendency of contact bouncing.

SUMMARY OF THE INVENTION

The invention provides contactor equipment of the kind mentioned in the introductory part of the description, in which mechanical stresses and wear, and hence the risk of functional disorders, are considerably reduced, as well as the tendency of contact bouncing.

What characterizes contact equipment according to the invention will become clear from the appended claims.

This is achieved according to the invention by eliminating the current control during the closing operation of the contactor and by supplying to the operating coil of the contactor a voltage whose mean value is substantially constant during the closing operation. In this way, the above-mentioned current- and acceleration-reducing effect of the movement of the armature will fully influence the final speed of the armature. This causes a contactor according to the invention to have a lower final speed of the armature, that is, a considerably smoother closing than the above-mentioned known contactors. This provides a reduction or elimination of the above-mentioned disadvantages in the form of wear, mechanical stress and contact bouncing. This advantageous effect is obtained without any arrangement other than a modification of the control equipment of the contactor, and while maintaining the initially mentioned advantages of a current-controlled contactor in the form of insensitivity to variations of the supply voltage and of the possibility of combining a rapid closing with a low current consumption in closed position.

A contactor according to the invention is preferably designed with pulse-width modulation of the coil current, whereby the pulse width during the closing operation is suitably maintained at a fixed value, which is chosen in dependence on the supply voltage immediately prior to the closing.

BRIEF DESCRIPTION OF THE DRAWINGS

In the following, the invention will be described in greater detail with reference to the accompanying FIGS. 1–3, wherein.

DESCRIPTION OF THE PREFERRED EMBODIMENTS

Figure 1:
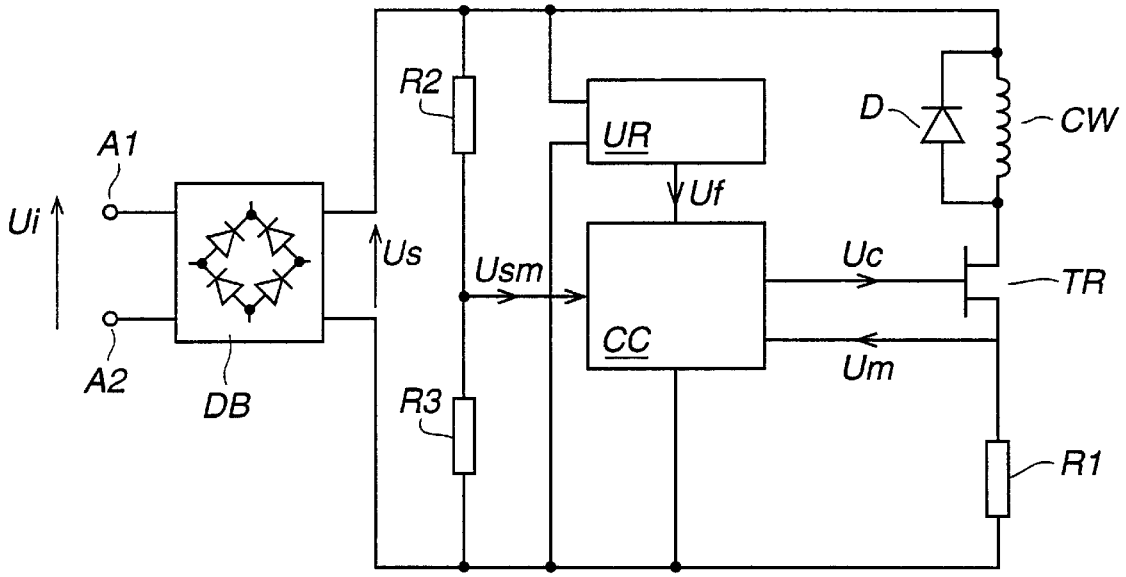
FIG. 1 schematically shows contactor equipment according to the invention.

FIG. 1 shows an example of contactor equipment according to the invention. The contactor has connecting terminals A1 and A2. The contactor is closed and is kept closed by supplying a supply voltage Ui to the connecting terminals. The contractor is openest by disconnecting the supply voltage. The contactor is intended to be connected optionally to either alternating voltage or direct voltage and to voltages within a large voltage interval, for example 80–275 V. The supply voltage is supplied to the contactor via a full-wave rectifier DB, the output voltage Us of which is thus a constant direct voltage (during direct-voltage supply) or a full-wave rectified alternating voltage (during alternating-voltage supply). This voltage is supplied to the operating coil CW of the contactor, which operating coil is series-connected to a switching transistor TR and a small series resistor R1 arranged for the current measurement. The operating coil is connected in anti-parallel with a freewheeling diode D.

The contactor has a control circuit CC adapted, with the aid of the transistor TR, to control the voltage across the operating coil by pulse-width modulation. The control circuit delivers a control signal Uc to the gate of the transistor and controls the transistor with a constant pulse frequency, for example 20 kHz, and with a variable pulse width. The control circuit is supplied with the voltage Um across the measuring resistor R1, which voltage is a measure of the current through the operating coil. A voltage divider formed by the resistors R2 and R3 delivers to the control circuit a measured signal Usm which is proportional to the voltage Us.

Figure 2:
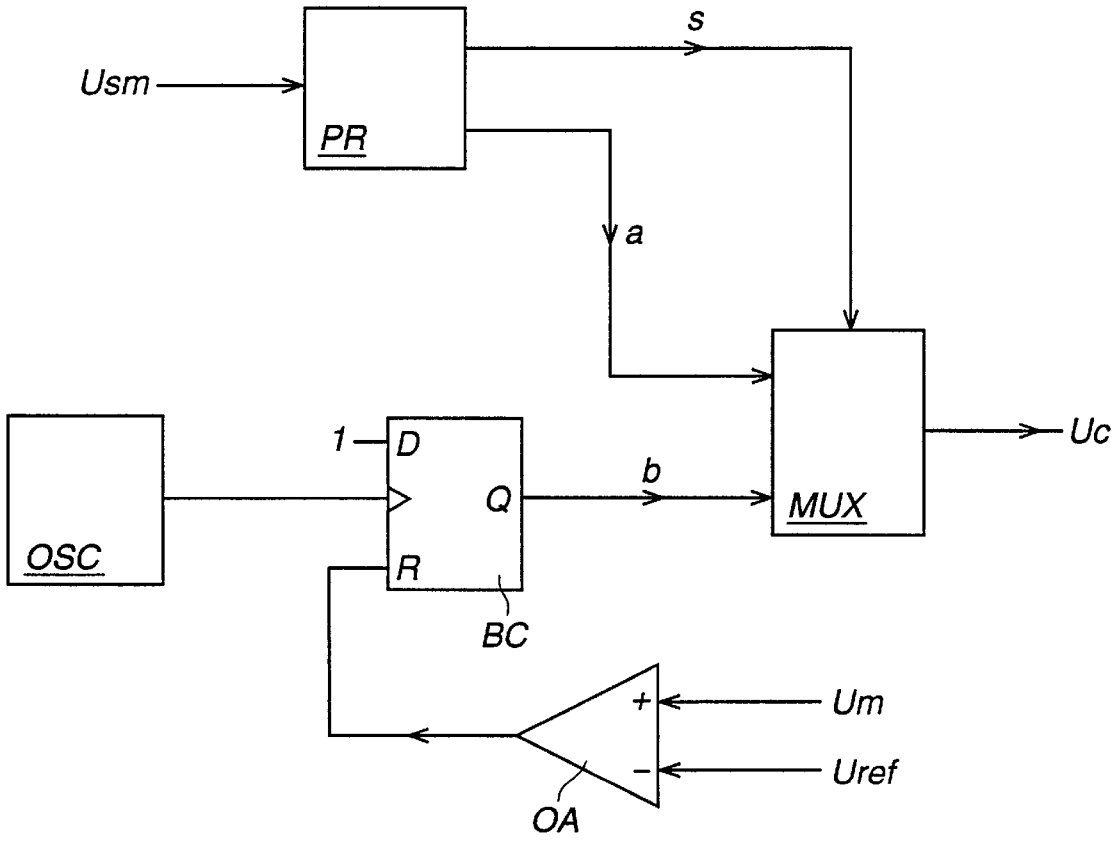
FIG. 2 shows in more detail the composition of the control circuits of the contactor equipment.

The control circuit CC receives a controlled supply voltage Uf, for example 10V, from a voltage controller UR. FIG. 2 shows the embodiment of the control circuit CC in the contactor shown in FIG. 1. A programmable circuit PR, for example a microprocessor, is supplied with the measured signal Usm corresponding to the supply voltage Ui (and Us). The mode of operation of the circuit PR will be described in greater detail below with reference to FIG. 3. The circuit PR supplies to a multiplexor MUX a control signal s, which determines which of the two input signals, a and b, of the multiplexor is to be connected to the output thereof and constitute the control signal Uc to the transistor TR, as well as a, control signal a which controls the transistor during the closing operation of the contactor.

When the contactor, after a completed closing operation, is in its closed position, the transistor is controlled by a circuit for current control, which comprises a pulse oscillator OSC, a bistable circuit BC and a differential amplifier OA. The oscillator is operating with a frequency of 20 kHz and delivers a pulse train with this frequency to a differentiating input of the circuit BC. The D input of the circuit BC is supplied with a constant signal which corresponds to a logic one. The two inputs of the amplifier OA are supplied with the measuring voltage from the resistor R1 corresponding to the coil current and with a reference signal Uref which corresponds to the lower value of the coil current which is desired to be maintained after a completed closing of the contactor. The output signal of the amplifier is supplied to the R-input of the circuit BC. The signal from the Q output of the circuit constitutes the output signal b of the circuit BC which is supplied to the multiplexor MUX. When the contactor is in the closed position, the control signal s from the circuit PR has a value such that the signal b constitutes the output signal Uc of the multiplexor and controls the transistor TR.

The mode of operation of the current control is as follows. The front flank of each pulse from the oscillator OSC sets the circuit BC at one, whereby the output signal b of the circuit as well as the output signal Uc of the multiplexor become "1" whereby the transistor TR is controlled to a conducting state. The current of the operating coil will then increase, and when the measured signal Um becomes greater than the reference value Uref, the output signal OA of the amplifier becomes "1", whereby the circuit BC is reset, the signals b and Uc become "0" and the transistor is controlled to a non-conducting state. In this way, the control circuit will automatically vary the pulse width of the voltage pulses supplied to the operating coil in such a way that the coil current is maintained at a desired value defined by the signal Uref.

Figure 3:
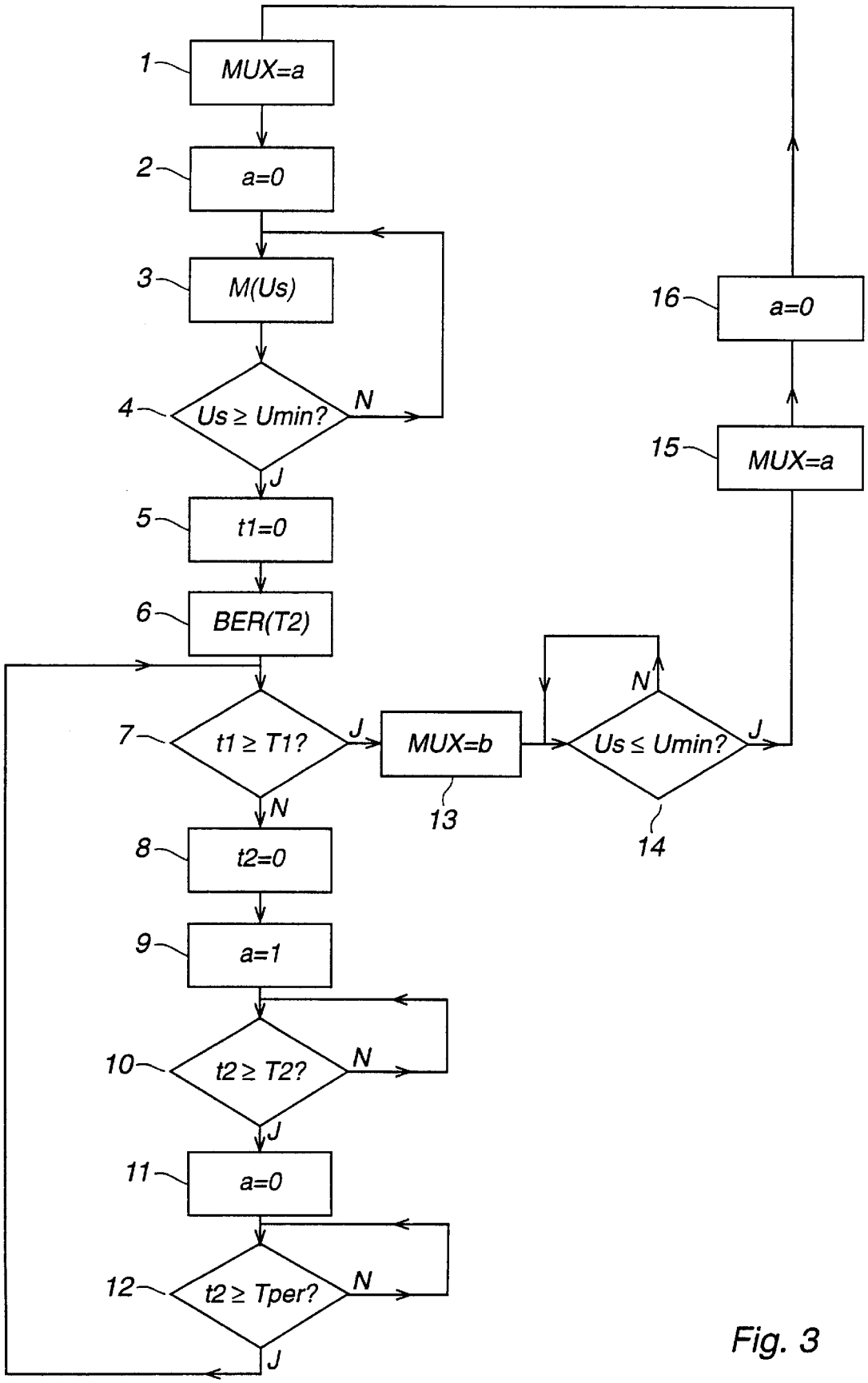
FIG. 3 illustrates in the form of a flow diagram the function of the programmable circuit included in the control circuits.

FIG. 3 shows in the form of a flow diagram the mode of operation of the programmable circuit PR shown in FIG. 2. For closing of the contactor, the contactor is supplied with the supply voltage Ui. The control circuits then start operating and the completion of the program is started beginning in block 1 (MUX=a). In this block, the multiplexor MUX is first adjusted to the input signal a, which then in block 2 (a=0) is set at a=0. This means that the control signal Uc to the transistor TR is set at "0" and the transistor is maintained in a non-conducting state. After this, a measured value corresponding to the root mean square of the voltage Us is formed in a known manner (the function M(Us)) in the block 3. The measurement may, for example, be performed by mean-value formation during a half period (in case of supply with alternating voltage) or during a predetermined period (in case of supply with direct voltage). When the measurement is completed, it is sensed in the block 4 (Us≧Umin?) whether the voltage Us is at least as large as the lower limit Umin (e.g. 80V) of the voltage interval (e.g. 80–275 V) which is intended for the contactor. If this is not the case, the program returns to block 3. If, on the other hand, U≧Umin this is interpreted as an order for closing. In block 5, a time counter is then reset and started (t1=0) and, on the basis of the latest measured value for the voltage Us, in block 6 (BER(T2)) a time T2 is calculated (see further below) which corresponds to the desired fixed pulse length during the closing operation. In block 7 (t1≧T1?) the time t1 is compared with a time T1 which is so chosen to corresponds to the duration of one closing operation. Thus, as long as t1<T1, the closing operation proceeds and the program then continues downwards in the figure with the blocks 7–12 (see below). When t1>T1, the closing operation is completed. In block 13, (MUX=b), the signal s is reset to a value so that the multiplexor forwards the signal b from the currentcontrol circuit. The transistor TR is then controlled in the manner described above such that the current of the operating coil is maintained at a value corresponding to the reference Uref. This is done as long as the contactor is supplied with a supply voltage which has at least the value Umin, which is sensed in the block 14 (Us<Umin).When an opening order is obtained by removing the supply voltage Ui, the program continues to block 15, where the multiplexor is adjusted to the input signal a (MUX=a), which in block 16 (a=0) is set at "0", whereby the transistor becomes non-conducting and the contactor is disconnected.

When a closing order has been received, a second time counter is reset and started in block 8 (t2=0). In block 9 (a=1) the signal a is set at "1" whereby the transistor is controlled to a conducting state. In block 10 (t2>T2?) the time t2 is compared to the time T2 which corresponds to the desired constant pulse length during the closing operation. This time is calculated in block 4 according to the relationship $$T2 = \frac{Umin}{Ui} \cdot Tper$$

where

Ui is the latest voltage-measuring value, and

Tper is the period corresponding to the constant pulse frequency (50 $\mu$s at 20 kHz).

Because of the chosen value of the time T2, the transistor will during the closing operation be continuously conducting if the supply voltage lies at the lower limit Umin of the intended voltage interval. At higher supply voltages, the pulse length T2 will decrease, and the mean value of the voltage which is applied to the operating coil during the closing operation becomes constant and independent of the supply voltage.

When t2>T2 the signal a is set at "0" in block 11 (a=0), that is, the transistor is made non-conducting. The transistor remains disconnected until it is indicated in block 12 (t2>Tper?) that a period has elapsed and the program returns to block 7.

In this way, during the closing operation, the operating coil of the contactor will be supplied with a voltage which is constant during the closing operation and which is independent of the supply voltage. Thus, the closing always follows a certain desired procedure in regards to the acceleration and speed of the armature. Further, by supplying a voltage, which is independent of the coil current to the operating coil during the closing operation, the current-reducing effect mentioned in the introduction and caused by the armature movement will have its full effect and reduce the final speed of the armature. It has been found that, by doing so, a considerable reduction of the disadvantages, such as wear, mechanical stresses and contact bouncing, associated with a "hard" closing operation can be obtained. These advantages are especially important in large contactors.

The contactor described above is only one example of how a contactor can be designed according to the invention. A large number of other embodiments are feasible within the scope of the invention.

I claim:

1. Contactor equipment with an electromagnetic contactor comprising:

an operating magnet with an operating coil for connection to a supply voltage source;

an armature which moves dependent on a current through said operating coil;

a number of contacts influenced by said armature; and a control means comprising:

a first means for controlling a voltage level supplied to said operating coil during a closing operation of said contactor such that said voltage level is independent of said current of said operating coil, whereby the current reducing effect of the change of inductance taking place because of the movement of said armature is utilized and wherein said voltage level supplied to said operating a coil during said closing operation is substantially equal to a minimum voltage for closing said contactor; and a second means for sensing said current through said operating coil and for controlling a voltage supplied to said operating coil after said closing operation is completed, based on said current in order to control said current in accordance with a current reference value, said current reference value being a minimum current required to hold said amature after said closing operation is completed.

2. Contactor equipment according to claim 1, wherein the control means are adapted to supply to the operating coil a pulse-width modulated voltage.

3. Contactor equipment according to claim 2, wherein the control means are adapted, during a closing operation, to operate with a constant pulse width.

4. Contactor equipment according to claim 3, wherein the control means are adapted, during a closing operation, to operate with a pulse width which is constant during the closing operation and dependent on the supply voltage source prior to the closing operation.

5. Contactor equipment according to claim 4, wherein the control means are adapted, during the closing operation, to maintain the pulse width at a value which is inversely proportional to the sensed supply voltage.

6. Contactor equipment according to claim 1, wherein the control means are adapted, during a closing operation, to supply to the operating coil a voltage whose mean value is substantially constant during the closing operation.

7. Contactor equipment according to claim 6, wherein the control means further comprises means for, prior to a closing operation, sensing the voltage of the supply voltage source and, during the closing operation, controlling the voltage supplied to the operating coil in dependence on the sensed supply voltage.

8. Contactor equipment with an electromagnetic contactor comprising:

an operating magnet with an operating coil for connection to a supply voltage source;

am armature which moves dependent on a current through said operating coil;

a number of contacts influenced by said armature; and a control means comprising:

a first means for controlling a voltage level supplied to said operating coil during a closing operation of said contactor to be independent of said current of said operating coil, whereby the current reducing effect of the change of inductance taking place because of the movement of said armature is utilized and wherein said voltage level supplied to said operating coil during said closing operation is substantially equal to a minimum voltage for closing said contactor; and a second means for sensing said current through said operation coil and for controlling said voltage supplied to said operation coil based on said current in order to control said current in accordance with a current reference value, after said closing operation is completed.

9. Contactor equipment according to claim 8, wherein the control means are adapted to supply to the operating coil a pulse-width modulated voltage.

10. Contactor equipment according to claim 9, wherein the first means are adapted, during a closing operation, to operate with a constant pulse width.

11. Contactor equipment according to claim 7, wherein the first means are adapted, during a closing operation, to operate with a pulse width which is constant during the closing operation and dependent on the supply voltage source prior to the closing operation.

12. Contactor equipment according to claim 11, wherein the first means are adapted, during the closing operation, to maintain the pulse width at a value which is inversely proportional to the sensed supply voltage.

13. Contactor equipment according to claim 8, wherein the first means are adapted, during a closing operation, to supply to the operating coil a voltage whose mean value is substantially constant during the closing operation.

14. Contactor equipment according to claim 13, wherein the first means further comprises means for, prior to a closing operation, sensing the voltage of the supply voltage source and, during the closing operation, controlling the voltage supplied to the operating coil in dependence on the sensed supply voltage.

* * * * *